US010561191B1

(12) United States Patent
Whitcomb

(10) Patent No.: US 10,561,191 B1
(45) **Date of Patent: *Feb. 18, 2020**

(54) HELMET HAVING HIGH PRESSURE NON-BURSTING GAS CELLS

(71) Applicant: John E. Whitcomb, Elm Grove, WI (US)

(72) Inventor: John E. Whitcomb, Elm Grove, WI (US)

( * ) Notice: Subject to any disclaimer, the term of this patent is extended or adjusted under 35 U.S.C. 154(b) by 460 days.

This patent is subject to a terminal disclaimer.

(21) Appl. No.: 15/171,083

(22) Filed: Jun. 2, 2016

Related U.S. Application Data

(63) Continuation of application No. 14/588,998, filed on Jan. 5, 2015, now Pat. No. 9,820,524, which is a continuation-in-part of application No. 14/337,582, filed on Jul. 22, 2014, now abandoned.

(60) Provisional application No. 61/967,291, filed on Mar. 10, 2014, provisional application No. 61/962,916, filed on Nov. 13, 2013.

(51) Int. Cl.

| | |
|---|---|
| ***A42B 3/12*** | (2006.01) |
| ***A42B 3/08*** | (2006.01) |
| ***A42B 3/28*** | (2006.01) |
| ***A63B 71/08*** | (2006.01) |
| ***F41H 1/04*** | (2006.01) |

(52) U.S. Cl.
CPC ..... *A42B 3/122* (2013.01); *A42B 3/08* (2013.01); *A42B 3/283* (2013.01); *A63B 71/081* (2013.01); *F41H 1/04* (2013.01)

(58) Field of Classification Search
CPC ..... A42B 3/003; A42B 3/121; A42B 3/122; A63B 71/081; A63B 71/10
USPC ..... 2/DIG. 10
See application file for complete search history.

(56) References Cited

U.S. PATENT DOCUMENTS

| | | | | | |
|---|---|---|---|---|---|
| 531,505 | A | * | 12/1894 | Brown | 137/223 |
| 2,381,524 | A | * | 8/1945 | Taylor | A42B 3/003 2/425 |
| 2,418,069 | A | * | 3/1947 | Delano | A42B 1/203 2/171.03 |
| 2,618,780 | A | * | 11/1952 | Cushman | A42B 3/122 2/209.7 |
| 2,664,567 | A | * | 1/1954 | Nichols | A42B 3/122 177/DIG. 7 |
| 3,259,912 | A | * | 7/1966 | Lima | A42B 1/12 2/174 |
| 3,320,682 | A | * | 5/1967 | Sliman | A45D 2/46 126/204 |
| 3,713,930 | A | | 1/1973 | Levrini et al. | |

(Continued)

*Primary Examiner* — Sally Haden

(74) *Attorney, Agent, or Firm* — Donald J. Ersler

(57) ABSTRACT

A helmet having non-bursting gas cells preferably includes a hard helmet shell, an outside gas cell impact layer and an inside gas cell impact layer. The outside gas cell impact layer preferably includes at least one gas cell layer and an outside layer of sheet material. Each gas cell layer includes a plurality of gas cells created between two plastic sheets. The inside gas cell impact layer includes the at least one gas cell layer. The inside and outside gas cell impact layers may be permanently or removably attached to hard helmet shell. A second embodiment of the helmet having non-bursting gas cells preferably includes the hard helmet shell, the outside gas cell impact layer and an inside gas cell inflatable impact layer. The inside gas cell inflatable impact layer preferably includes at least one inflatable gas cell layer and a check valve.

13 Claims, 10 Drawing Sheets

(56) References Cited

U.S. PATENT DOCUMENTS

| | | | | | |
|---|---|---|---|---|---|
| 3,872,511 | A | | 3/1975 | Nichols | |
| 3,999,220 | A | | 12/1976 | Keltner | |
| 4,287,250 | A | * | 9/1981 | Rudy | A43B 13/20 206/522 |
| 4,324,005 | A | * | 4/1982 | Willis | A42B 3/0486 2/413 |
| 4,586,200 | A | | 5/1986 | Poon | |
| 4,843,642 | A | * | 7/1989 | Brower | A42B 3/125 2/414 |
| 5,129,107 | A | | 7/1992 | Lorenzo | |
| 5,259,070 | A | * | 11/1993 | De Roza | A42B 3/0486 2/413 |
| 5,263,203 | A | | 11/1993 | Kraemer et al. | |
| 5,274,846 | A | * | 1/1994 | Kolsky | A41D 13/0156 2/16 |
| 5,667,224 | A | * | 9/1997 | Streckert | F16J 15/52 220/62.11 |
| 5,669,079 | A | | 9/1997 | Morgan | |
| 6,065,159 | A | * | 5/2000 | Hirsh | A42B 1/08 2/414 |
| 6,131,196 | A | * | 10/2000 | Vallion | A41D 13/0568 2/24 |
| 6,709,062 | B2 | | 3/2004 | Shah | |
| 6,811,463 | B2 | * | 11/2004 | Martz | A41C 3/0057 2/267 |
| 8,181,271 | B2 | * | 5/2012 | Sasaki | A41D 13/065 2/24 |
| 8,505,116 | B2 | * | 8/2013 | Strong | A42B 1/004 2/200.1 |
| 8,640,267 | B1 | * | 2/2014 | Cohen | A42B 3/063 2/411 |
| D768,339 | S | * | 10/2016 | Auger | D29/123 |
| 2006/0168706 | A1 | * | 8/2006 | Auger | A41D 19/01523 2/161.6 |

* cited by examiner

HELMET HAVING HIGH PRESSURE NON-BURSTING GAS CELLS

CROSS-REFERENCES TO RELATED APPLICATIONS

This is a continuation-in-part application, which takes priority from non-provisional application Ser. No. 14/588,998 filed on Jan. 1, 2015, which takes priority from patent application Ser. No. 14/337,582 filed on Jul. 22, 2014, which claims the benefit of provisional application No. 61/967,291 filed on Mar. 10, 2014 and provisional application No. 61/962,916 filed on Nov. 13, 2013.

BACKGROUND OF THE INVENTION

Field of the Invention

The present invention relates generally to helmets and more specifically to a helmet having a plurality of non-bursting gas cells, which includes at least one gas cell impact layer.

Discussion of the Prior Art

The purpose of protective helmets is to prevent head injury incurred during some event, such as football, ice hockey, horseback riding, skiing, lacrosse, baseball, riding a motorcycle, construction and military combat. Helmets were first invented for protection in military engagements, and as such, started as protection from hand held weapons and evolved in the $20^{th}$ Century to protect from projectiles and explosives. As such, rigid, impenetrable helmets have been the paradigm we have used for the prevention of head injuries.

Rigid helmets have been partially successful at preventing injuries. However, the recent epidemic of concussions and the increasing awareness of the cumulative problems associated with repeated head trauma have unpacked the limitations of the current structure of protective helmets in all sports. Indeed, the same limitation could be claimed for all protective helmets including construction and military helmets.

The physics of head injury is all focused on the distance over which deceleration occurs. The human brain is very fragile, being composed of cells wrapped in membranes made of fluid fatty acids. Several trillion synapses in the brain are delicately poised in proximity to one another, without rigid and strong connections. These synapses are the functional means by which the brain operates. Shaking them disrupts them. The human nervous system has developed a host of strategies to enshrine the delicate neurons and their even more delicate synapses in a protective cocoon of safety. First and foremost, the brain is floating in water (otherwise called the cerebral spinal fluid), creating a bath without rigid inflexible supports. Within that water, the brain is suspended in a delicate spider web of suspending fibers and membranes that keep water from moving too quickly around the surface and allowing the soft brain to be gently suspended within the bony structure of the skull. The skull provides a rigid structure to contain the floating bath of fluid. Of note, the skull can be cracked and shattered as one strategy of dissipating force. This may lead to survival with subsequent healing. It is a unique and delicate bony structure around the brain, not seen anywhere else in the human body. The scalp provides an additional layer of safety. It is mobile and gives when struck, providing a few extra millimeters of deceleration distance. The scalp uniquely tears when stressed by direct blows, creating yet another mechanism of safety. The tearing creates large and dramatic scalp wounds in direct head trauma, but the brain underneath survives. Finally, the human skull is surrounded by hair, which can provide another layer of cushioning.

What are the physics of deceleration injury? The formula is simple: ΔVelocity/time=Deceleration. The change in velocity is divided by time. Rigid structures striking each other have a spike of deceleration within the first 0.00001 seconds. The more rigid and brittle, the higher the G-force generated for a shorter fragment of time. The Holy Grail of injury prevention in deceleration injury is to increase the distance and therefore time during which deceleration occurs. We are familiar with automobiles and have seen the effectiveness of airbags that increase the distance of deceleration of the human torso before it strikes the steering wheel. Vehicles are also designed to crumple so that force is taken up by bending metal, collapsing frames, shattering fenders, stretching seatbelts all of which increase the distance and time over which the human inside decelerates. Each of these strategies also complements the others, and the final mechanism of safety, the air bag, to have a net effect of human survival, lowing the G forces from sufficient to break bones to simple sprains, strains and bruises.

Protective helmets have, to date, failed to provide a complete cocoon of safety. If the analogy to the human head can be used, protective helmets provide a skull and the inner dura, but there is no outer layer of safety. There is no scalp. No hair. Some advances have been made with the use of external foam with the SG Helmet. The missing ingredient in foam is that it fails to "fail". The human scalp tears and gives way. Foam doesn't tear. It does provide distance for greater deceleration, resulting in reduction of concussion injuries.

The value of gas bubbles is that they easily deform, have little weight, stretch, deform rapidly with increasing resistance and, when properly constructed with pressure, resist and push back . . . , The essential stretching and increasing gas pressure upon contact makes for a gradient of deceleration, which will provide protection. Foam deforms but is not as fluid as gas bubbles, has greater weight, which may result in rotational injuries of the neck.

U.S. Pat. No. 3,713,390 to Lerini et al. discloses a process to form elements under pressure, which is herein incorporated by reference in its entirety. U.S. Pat. No. 3,872,511 to Nichols discloses protective headgear. U.S. Pat. No. 3,999,220 to Keltner discloses air cushioned protective gear. U.S. Pat. No. 4,586,200 to Poon discloses a protective crash helmet. U.S. Pat. No. 5,129,107 discloses an inflatable safety helmet specially for motorcycling. U.S. Pat. No. 5,263,203 to Kraemer et al. discloses an integrated pump mechanism and inflatable liner for protective. U.S. Pat. No. 5,669,079 to Morgan discloses a safety enhanced motorcycle helmet. U.S. Pat. No. 6,709,062 to Shah discloses a head restraint for a passenger of a vehicle.

Accordingly, there is a clearly felt need in the art for a helmet having non-bursting gas cell, which includes at least one gas cell impact layer mounted to an exterior and an interior of a hard shell helmet.

SUMMARY OF THE INVENTION

The present invention provides a soft helmet having blunt force trauma protection, which includes at least one gas bubble impact layer. The soft helmet is suitable for cycling, medical or any other type of application that requires protection against head injury. The medical helmet applications include adults with uncontrolled seizure disorder, children who have repetitive head banging behavior, post neurosurgical interventions requiring skull protection or any other brain endangering behavior that requires a protective helmet.

The soft helmet having blunt force trauma protection (soft helmet) includes a base shell member, at least one gas bubble impact layer and a removable retention strap. The base shell member is shaped or formed to fit on a top of a human head. The base shell member is preferably fabricated from a flexible sheet of synthetic fiber material, such as Kevlar, but other materials may also be used. The inner and outer gas bubble impact layers include a plurality of gas filled bubbles, which do not burst upon impact. The gas is preferably air, but could be any other suitable gas, such as substantially pure nitrogen or argon.

The plurality of bubbles are created between two flexible sheets of material. Each bubble retains the gas therein and does not pass it to an adjacent bubble. Each bubble preferably includes a substantially elliptical shape in a horizontal plane and a substantially half elliptical shape in a vertical plane for increasing aerodynamics. The at least one gas bubble impact layer is permanently attached to the base shell member with adhesive or any other suitable substance or method. Ventilation openings are preferably formed between adjacent bubbles and through the at least one impact layer and the base member. The removable retention strap is preferably secured to opposing sides of a bottom of the base shell member with sewing or any other suitable method. Retention straps are well known in the art and need not be explained in detail.

A second embodiment of a soft helmet includes the base shell member, at least two gas bubble impact layers and a removable retention strap. The base shell member is shaped or formed to fit on a top of a human head. The at least one gas bubble impact layer includes a plurality of small gas filled bubbles, which do not burst upon impact. The plurality of bubbles are created between two flexible sheets of material. Each small bubble retains the gas therein and does not pass it to an adjacent bubble. Each small bubble preferably includes a substantially round or hexagonal shape in a horizontal plane. A first gas bubble impact layer is permanently attached to the base shell member with adhesive or any other suitable substance or method. A second gas bubble impact layer is permanently attached to a top of the first gas bubble impact layer with adhesive or any other suitable method. Ventilation openings are preferably formed between adjacent bubbles and through the at least two gas bubble impact layers and the base member. The removable retention strap is preferably secured to opposing sides of the bottom of the base shell member with sewing or any other suitable method.

A helmet having non-bursting gas cells preferably includes a hard helmet shell, an inside gas cell impact layer and an outside gas cell impact layer. The gas cells in the inside and outside gas cell impact layers do not burst upon impact. The hard helmet shell may be any type of prior art helmet, such as a football helmet, a motorcycle helmet, a bicycle helmet, a baseball helmet, baseball cap, construction helmet, medical helmet, lacrosse helmet or any type of protective helmet for a human head. The outside gas cell impact layer preferably includes at least one gas cell layer and an outside layer of sheet material. Each gas cell layer includes a plurality of gas cells created between two plastic sheets. Gas is not transferred between the plurality of gas cells. The plurality of cells preferably have a hexagon shape, but other shapes may also be used, such as round or square. The inside gas cell impact layer includes the at least one gas cell layer. The outside gas cell impact layer may be permanently or removably attached to an outside surface of the hard helmet shell. The inside gas cell impact layer may be permanently or removably attached to an inside surface of the hard helmet shell. Alternatively, a minimum pressure of the gas inside each gas bubble or gas cell is one of 1.2 atmospheres, 1.5 atmospheres or 2.0 atmospheres in order to create sufficient deceleration.

A second embodiment of the helmet having non-bursting gas cells preferably includes a hard helmet shell, an inside gas cell inflatable layer and an outside gas cell impact layer. The gas cells in the inside gas cell inflatable layer and the outside gas cell impact layer do not burst upon impact. The hard helmet shell is from any type of prior art helmet as previously discussed. The outside gas cell impact layer preferably includes the at least one gas cell layer and the outside layer of sheet material. The outside gas cell impact layer may be permanently or removably attached to an outside surface of the hard helmet shell. The inside gas cell inflatable impact layer preferably includes at least one inflatable gas cell layer and a check valve. Each inflatable gas cell layer includes a plurality of cells created between two flexible sheets of material. A plurality of gas passages are created between adjacent gas cells in at least one direction. An gas fill manifold system is also created to supply a row or column of gas cells with pressurized gas. The plurality of gas passages and the gas fill manifold are created between the two sheets flexible sheets of material. A check valve is attached to an entrance of the manifold. The check valve does not allow pressurized gas from escaping the plurality of gas cells. A fill nozzle of the check valve is filled to a predetermined gas pressure reading. The inside gas cell impact layer may be permanently or removably attached to an inside surface of the hard helmet shell. The fill nozzle of the check valve preferably extends past an outside surface of the helmet.

Accordingly, it is an object of the present invention to provide a soft helmet, which includes at least one gas bubble impact layer having a plurality of elliptical bubbles mounted to a flexible base member.

It is another object of the present invention to provide a soft helmet, which includes at least two gas bubble impact layer having a plurality of small bubbles mounted to a flexible base member.

It is a further object of the present invention to provide a soft helmet, which includes an gas bubble impact layer disposed on an outside surface of the helmet.

It is yet a further object of the present invention to provide a helmet having a plurality of non-bursting gas cells, which includes inside and outside gas cell impact layers located on inside and outside surface of a hard helmet shell.

It is yet a further object of the present invention to provide a helmet having a plurality of non-bursting gas cells, which includes an inside gas cell inflatable impact layer and an outside gas cell impact layer located on inside and outside surfaces of the helmet.

Finally, it is an object of the present invention to provide a soft or hard helmet, which includes at least one gas bubble impact layer disposed on at least one of an inside surface and an outside surface of the helmet with the gas cells manufactured under atmospheric pressure of at least 1.2 atmospheres.

These and additional objects, advantages, features and benefits of the present invention will become apparent from the following specification.

DETAILED DESCRIPTION OF THE PREFERRED EMBODIMENTS

Figure 1:
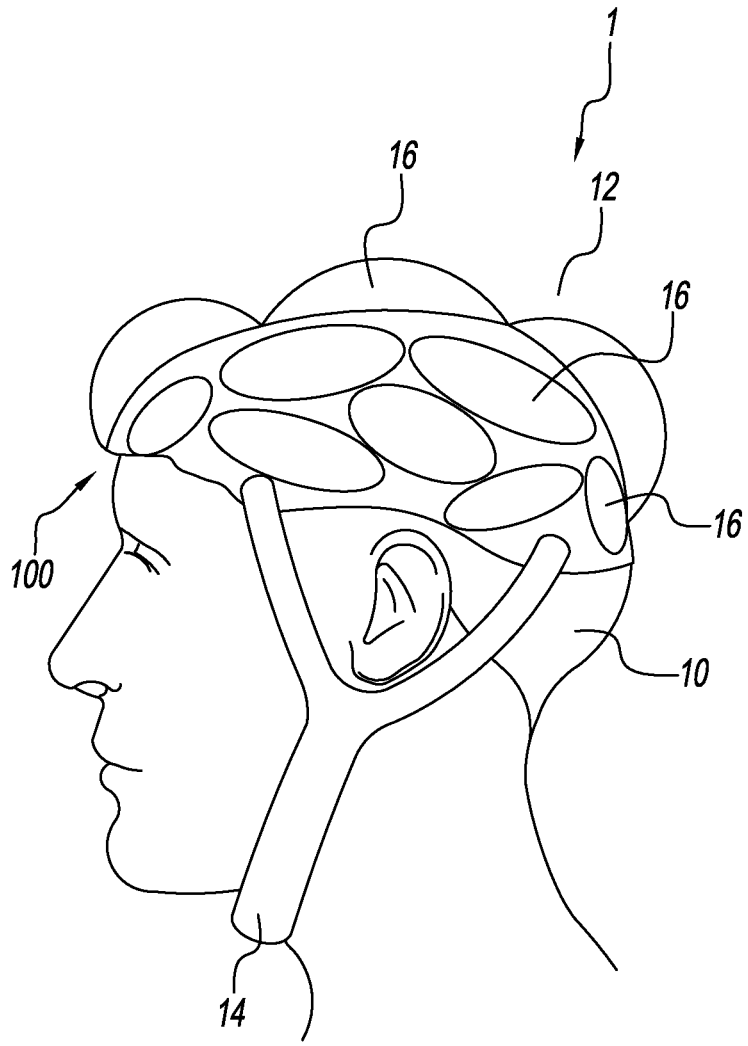
FIG. 1 is a side view of a user wearing a soft helmet in accordance with the present invention.
Figure 2:
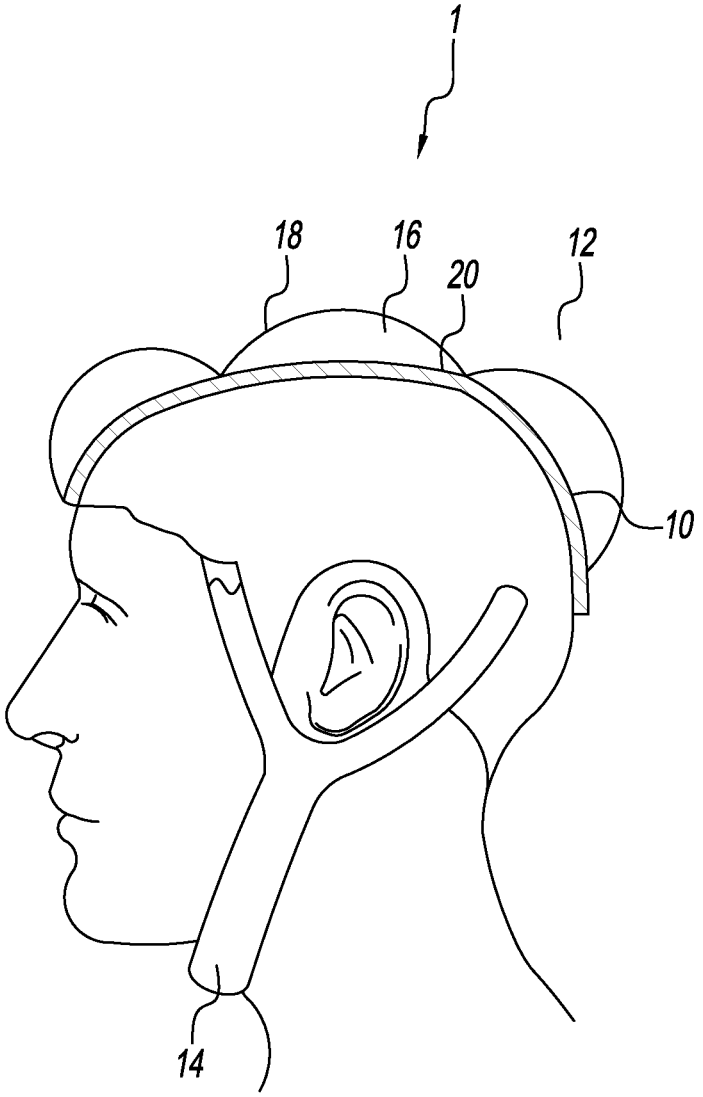
FIG. 2 is a side cross sectional view of a user wearing a soft helmet in accordance with the present invention.

With reference now to the drawings, and particularly to FIG. 1, there is shown a side view of a user wearing a soft helmet 1. The soft helmet 1 includes a base shell member 10, at least one gas bubble impact layer 12 and a retention strap 14. The base shell member 10 is shaped or formed to fit on a top of a human head 100. The base shell member 10 is fabricated from a flexible sheet of synthetic fiber material, such as Kevlar. The at least one gas bubble impact layer 12 includes a plurality of gas filled bubbles 16, which do not burst upon impact. The plurality of bubbles 16 are created between two flexible sheets of material 18, 20. The flexible sheets of material 18, 20 are fabricated from air impermeable material. The gas is preferably air, but could be any other suitable gas, such as substantially pure nitrogen or argon. Each bubble 16 retains the gas therein and does not pass it to an adjacent bubble 16. Each bubble 16 preferably includes a substantially elliptical shape in a horizontal plane and a substantially half elliptical shape in a vertical plane for increasing aerodynamics.

Figure 3:
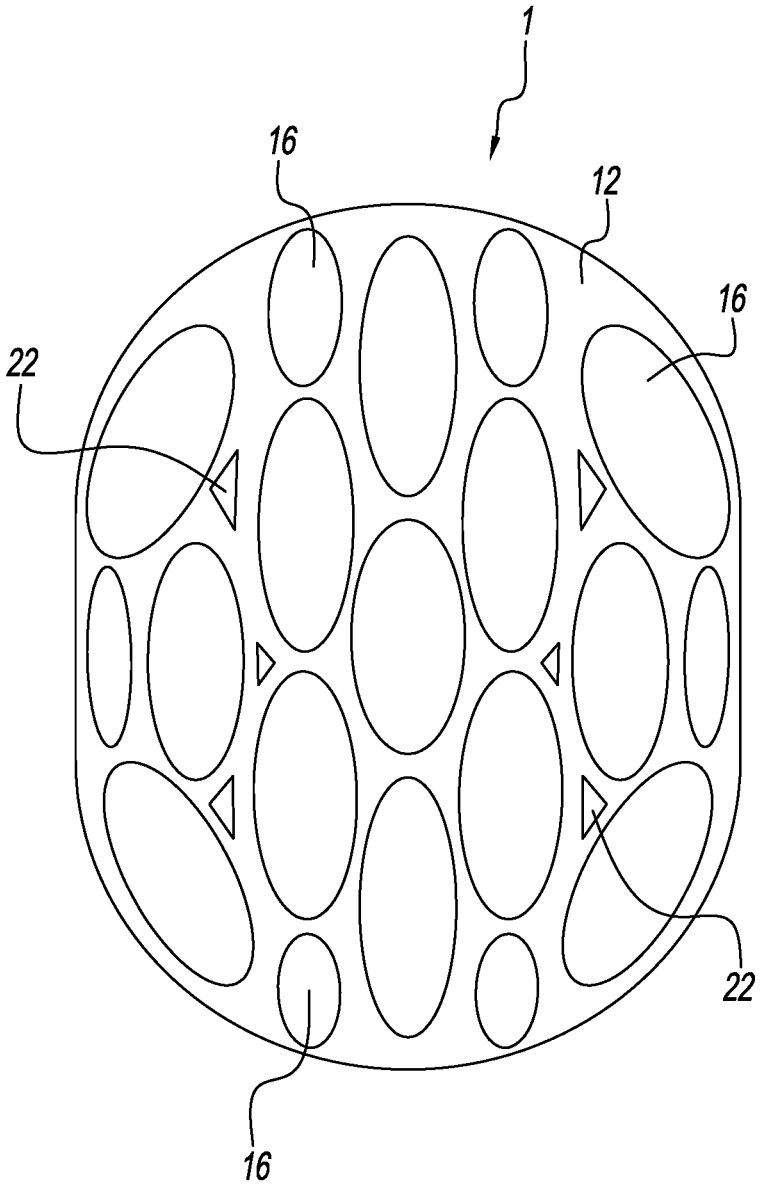
FIG. 3 is a top view of a soft helmet in accordance with the present invention.
Figure 4:
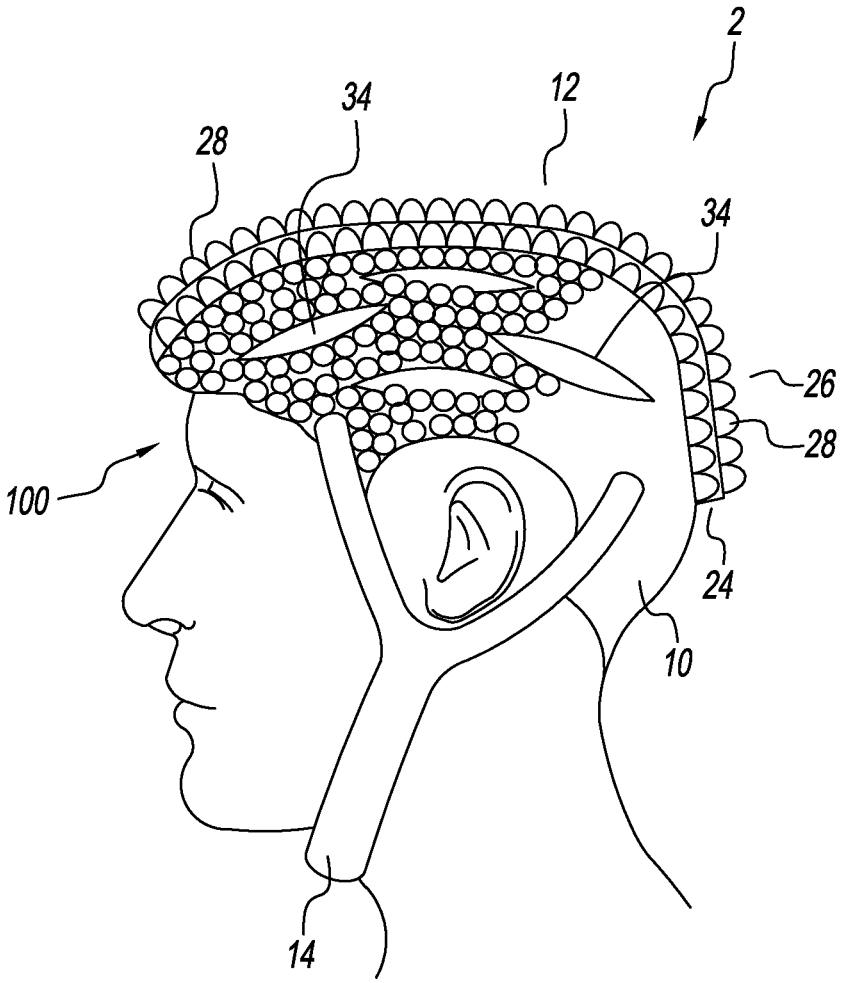
FIG. 4 is a side view of a second embodiment of a soft helmet in accordance with the present invention.
Figure 5:
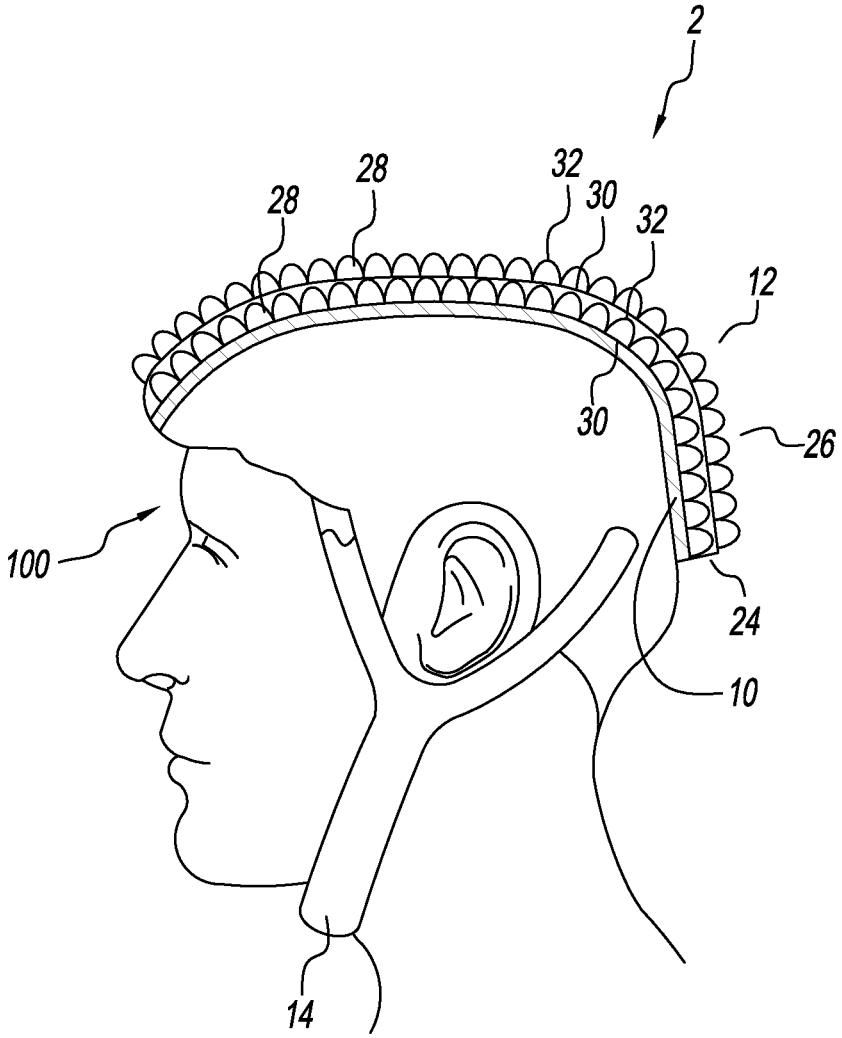
FIG. 5 is a side cross sectional view of a second embodiment of a soft helmet in accordance with the present invention.
Figure 6:
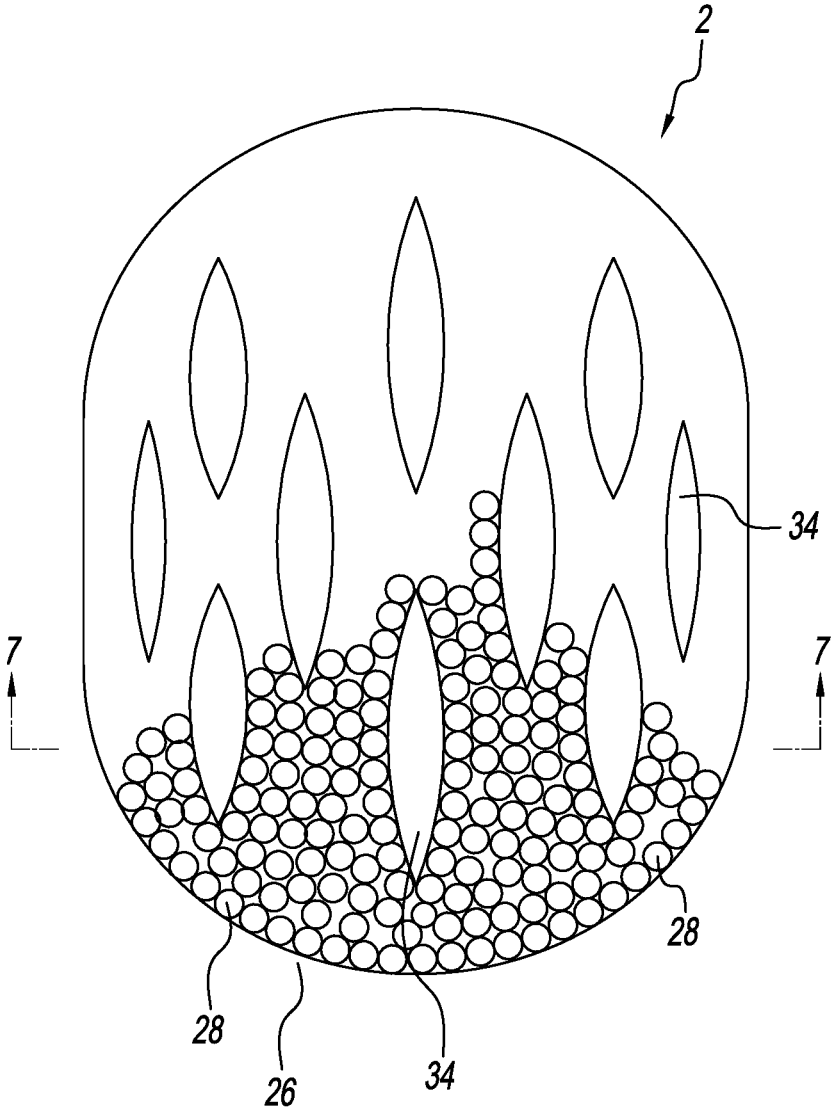
FIG. 6 is a top view of a second embodiment of a soft helmet in accordance with the present
Figure 7:
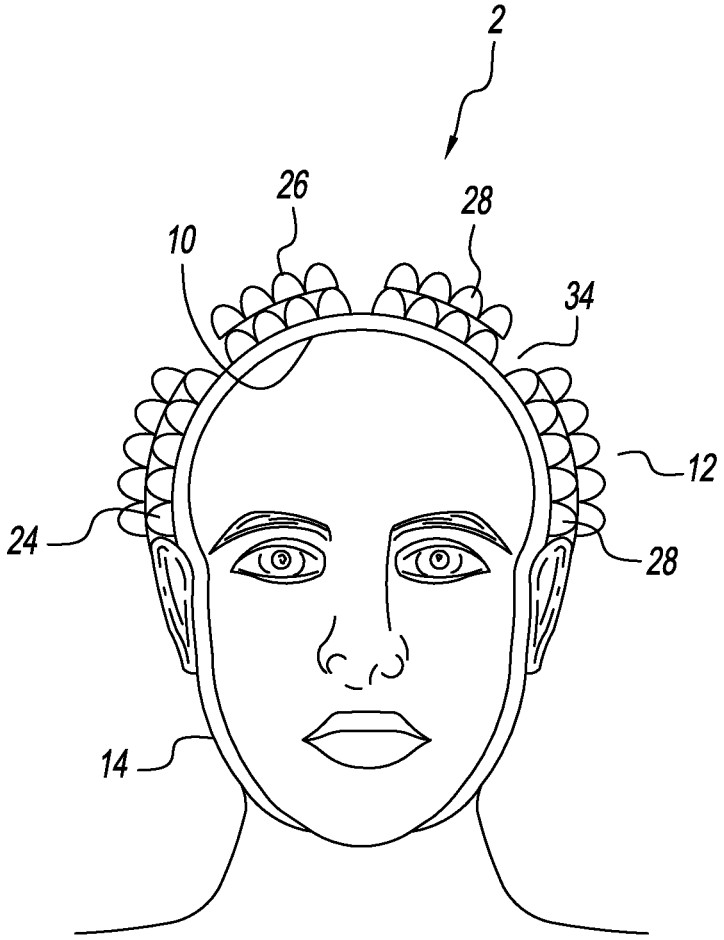
FIG. 7 is a front cross sectional view cut through FIG. 6 of a second embodiment of a soft helmet in accordance with the present.

The plurality of bubbles 16 may be different sizes to optimize nesting of the bubbles 16 on the impact layer 12. The at least one gas bubble impact layer 12 is permanently attached to the base shell member 10 with adhesive or any other suitable substance or method. With reference to FIG. 3, ventilation openings 22 are preferably formed through the impact layer 12 and the base shell member 10. The retention strap 14 is preferably secured to opposing sides of a bottom of the base shell member 10 with sewing or any other suitable method. Retention straps are well known in the art and need not be explained in detail.

A second embodiment of a soft helmet 2 includes the base shell member 10, at least two gas bubble impact layers 24, 26 and the removable retention strap 14. The base shell member 10 is shaped or formed to fit on the top of the human head 100. The at least two gas bubble impact layers 24, 26 include a plurality of small gas filled bubbles 28, which do not burst upon impact. The plurality of small bubbles 28 are created between two flexible sheets of material 30, 32. Each small bubble 28 retains the gas therein and does not pass it to an adjacent bubble 28. Each small bubble 28 preferably includes a substantially round shape in a horizontal plane. The soft helmet 2 is suitable for cycling. The first impact layer 24 is permanently attached to the base shell member 10 with adhesive or any other suitable substance or method. The second impact layer 26 is permanently attached to a top of the first impact layer 24 with adhesive or any other suitable method. Ventilation openings 34 are preferably formed through the at least two impact layers 24, 26 and the base member 10. The removable retention strap 14 is preferably secured to opposing sides of the bottom of the base shell member 10 with sewing or any other suitable method.

Figure 8:
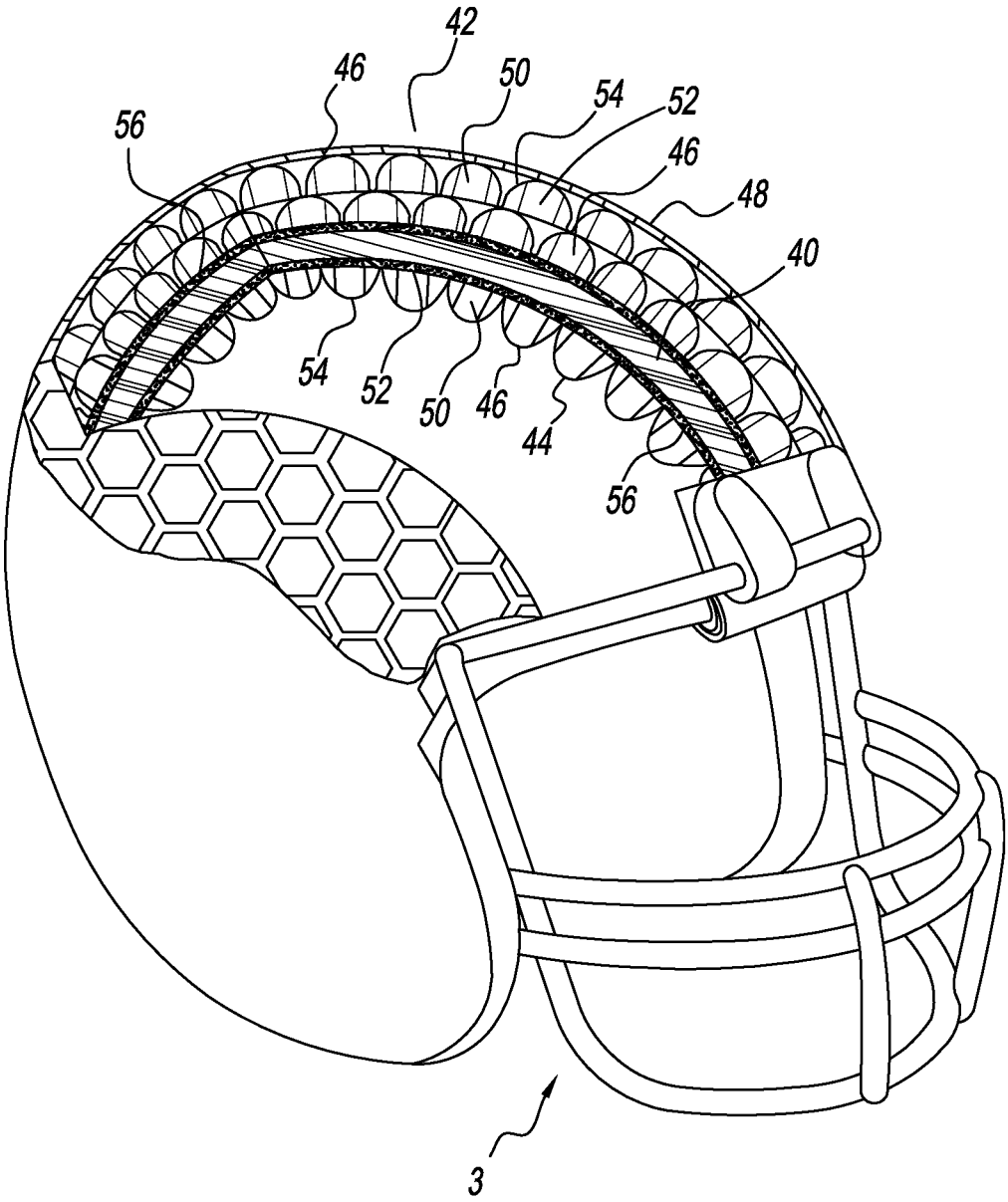
FIG. 8 is a perspective cut-away view of a helmet having non-bursting gas cells with inside and outside gas cell impact layers in accordance with the present invention.

With reference to FIG. 8, a helmet having non-bursting gas cells 3 preferably includes a hard helmet shell 40, an outside gas cell impact layer 42 and an inside gas cell impact layer 44. The gas cells 50 in the inside and outside gas cell impact layers do not burst upon impact. The hard helmet shell 40 is any type of prior art helmet, such as a football helmet, a motorcycle helmet, a bicycle helmet, a baseball helmet, baseball cap, construction helmet, medical helmet, lacrosse helmet or any type of protective helmet for a human head. The outside gas cell impact layer 42 preferably includes at least one gas cell layer 46 and an outside layer of sheet material 48. Team identification may be printed on the outside layer of sheet material 48. The at least one gas cell layer 46 includes a plurality of gas cells 50 created by a base sheet 52 and a cell sheet 54. Gas is not transferred between the plurality of gas cells 50. The plurality of gas cells 50 preferably have a hexagon shape, but other shapes may also be used, such as round or square.

The at least one gas cell layer 46 may be permanently attached to an outside surface of the hard helmet shell 40 or removably attached with a removable attachment system 56. The removable attachment system 56 is preferably hook and loop fastening pads, but other suitable removable attachment systems may also be used. A second gas cell layer 46 may be attached to a top of the gas cell layer 46 with adhesive or any other suitable method. The outside layer of sheet material 48 is permanently attached to a top of the gas cell layer 46 or the second gas cell layer 46 with adhesive or any other suitable method. The inside gas cell impact layer 44 includes the at least one gas cell layer 46. The at least one gas cell layer 46 may be permanently attached to an inside surface of the hard helmet shell 40 or removably attached with the removable attachment system 56. Alternatively, a minimum pressure of the gas inside each gas bubble 16, 28 and each gas cell 50 is one of 1.2 atmospheres (1.0 atmosphere of pressure is 14.7 psi), 1.5 atmospheres or 2.0 atmospheres. Each gas bubble 16, 28 and each gas cell 50 may be filled inside an enclosure, which is pressurized to the same or nearly the same pressure.

Figure 9:
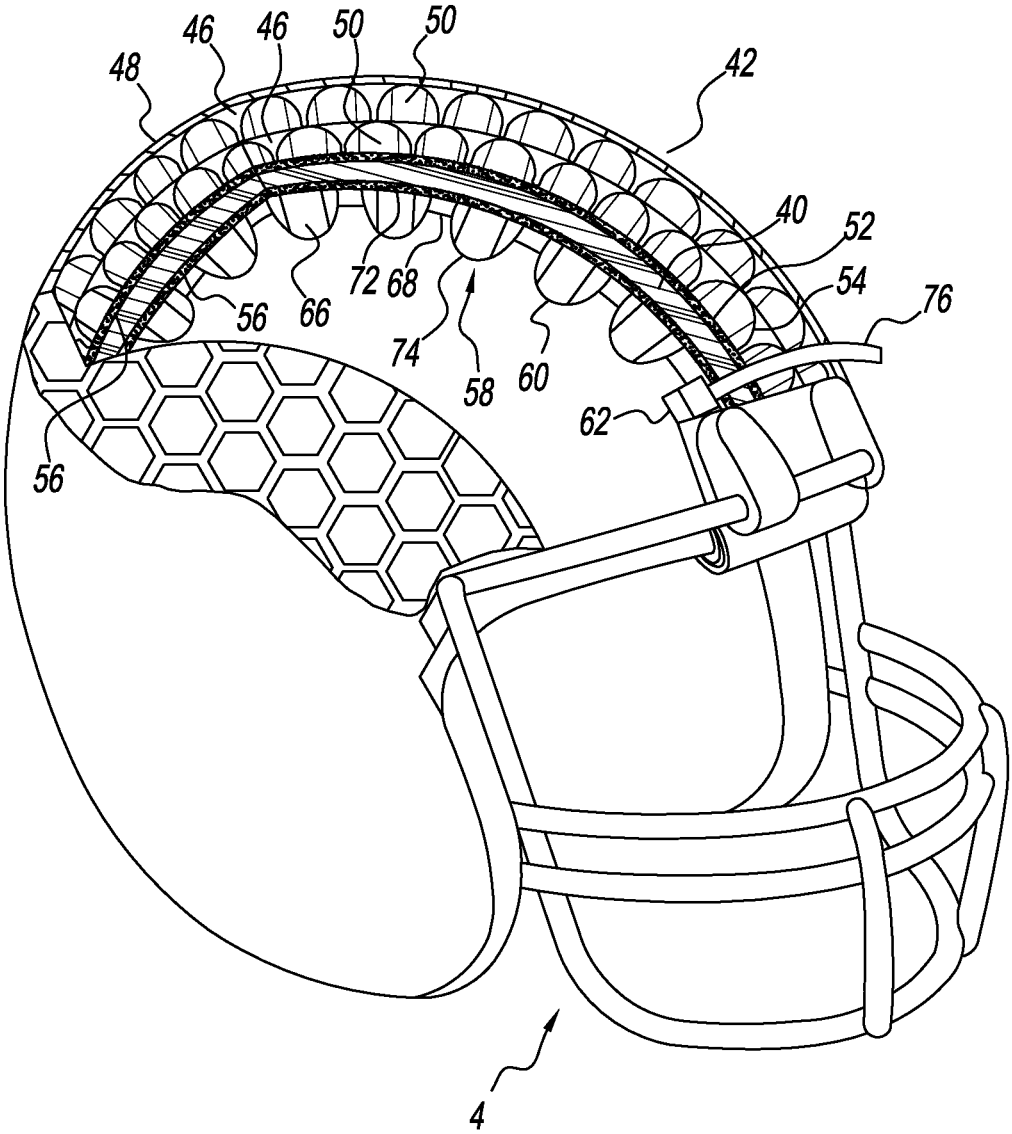
FIG. 9 is a perspective cut-away view of a helmet having non-bursting gas cells with an inside gas cell inflatable layer and an outside gas cell impact layer in accordance with the present invention.

With reference to FIG. 9, a second embodiment of the helmet having non-bursting gas cells 4 preferably includes the hard helmet shell 40, the outside gas cell impact layer 42 an inside gas cell inflatable impact layer 58. The gas cells 50 in the inside and outside gas cell impact layers do not burst upon impact. The outside gas cell impact layer 42 preferably includes the at least one gas cell layer 46 and the outside layer of sheet material 48. The outside gas cell impact layer 42 may be permanently or removably attached to an outside surface of the hard helmet shell as previously described.

Figure 10:
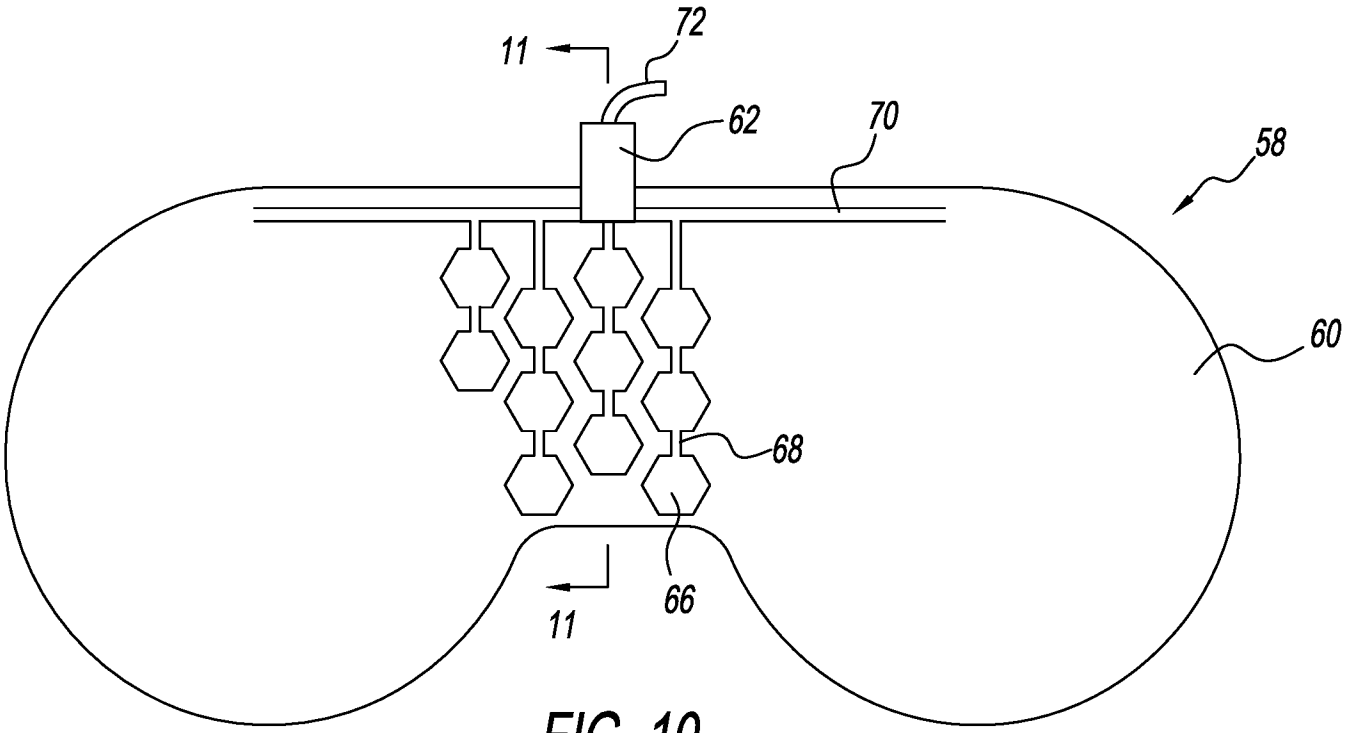
FIG. 10 is a top view of an inside gas cell inflatable layer of a helmet having non-bursting gas cells in accordance with the present invention.
Figure 11:
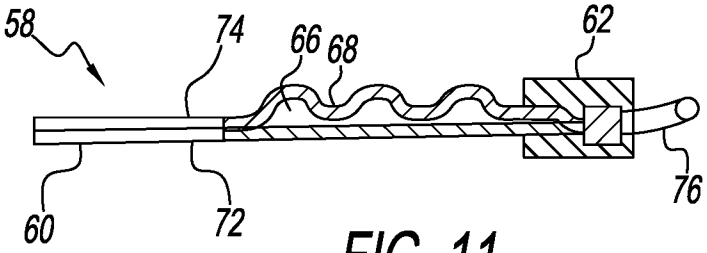
FIG. 11 is a cross sectional view of an inside gas cell inflatable layer of a helmet having non-bursting gas cells in accordance with the present invention.

With reference to FIGS. 10-11, the inside gas cell inflatable layer 58 preferably includes at least one inflatable gas cell layer 60 and a check valve 62. The outer perimeter of the inflatable gas cell layer 60 is shaped to fit inside the hard helmet shell 40. A plurality of gas cells 66, a plurality of gas passages 68 and an gas manifold 70 are preferably formed between a base sheet 72 and a cell sheet 74. Pressurized gas flows into an entrance of the check valve 62 through the fill nozzle 76. The pressured gas flows into the gas fill manifold 70 through the check valve 62. The gas fill manifold 70 distributes the pressurized gas to the plurality of gas passages 68 and the plurality of gas cells 66. The inside gas cell inflatable layer 58 may be permanently or removably attached to an inside surface of the hard helmet shell 40. The fill nozzle 76 of the check valve preferably extends past an outside surface of the helmet 40. Gas pressure may be measured with an gas pressure gage.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A helmet having non-bursting gas cells comprising:

a hard shell helmet capable of protecting a human head;

at least one pre-inflated outside gas cell layer includes an outside base sheet and an outside cell sheet, a plurality of outside gas cells are created by joining said outside cell sheet to said outside base sheet, each one of said plurality of outside gas cells retains gas therein and does not pass the gas therein to an adjacent one of said plurality of outside gas cells, said plurality of outside cells do not burst upon impact, said at least one pre-inflated outside gas cell layer is retained on an outside surface of said helmet shell, a minimum pressure of gas inside said plurality of outside gas cells is at least 1.2 atmospheres; and at least one inside gas cell layer includes an inside base sheet and an inside cell sheet, a plurality of inside gas cells are created by joining said inside cell sheet to said inside base sheet, each one of said plurality of inside gas cells retains gas therein and does not pass the gas therein to an adjacent one of said plurality of inside gas cells, said plurality of inside cells do not burst upon impact, said at least one inside gas cell layer is retained in an inside surface of said helmet shell, a minimum pressure inside said plurality of inside gas cells is at least 1.2 atmospheres.

2. The helmet having non-bursting gas cells of claim 1, further comprising:

an outer layer of sheet material is attached to said outside cell sheet.

3. The helmet having non-bursting gas cells of claim 1 wherein:

said plurality of inside and outside gas cells having a shape of at least one of hexagon and round.

4. The helmet having non-bursting gas cells of claim 1 wherein:

said helmet is one of a football helmet, a motorcycle helmet, a bicycle helmet, a baseball helmet, baseball cap, construction helmet, medical helmet, a lacrosse helmet, an ice hockey helmet, a horseback riding helmet, a skiing helmet, a lacrosse helmet, a construction and military combat helmet.

5. The helmet having non-bursting gas cells of claim 1 wherein:

the gas of said at least one pre-inflated outside gas cell layer and said inside gas cell layer being one of air, substantially pure nitrogen and argon.

6. A soft helmet having blunt force trauma protection comprising:

a base shell member fabricated from a flexible sheet, said base shell member includes a substantially hemispherical shape, said base shell member is adapted to cover substantially all of a top of a user's head;

at least one impact layer includes a plurality of non-bursting gas filled bubbles, an entire outer surface area of said plurality of non-bursting gas filled bubbles are sealed to prevent the escape of the gas therein during an impact, each one of said plurality of non-bursting gas filled bubbles retains gas therein and does not pass the gas therein to an adjacent one of said plurality of outside gas cells, said at least one impact layer is attached to an outer surface of said base shell member, a minimum pressure of gas inside said plurality of non-bursting gas filled bubbles is at least 1.2 atmospheres; and a retention strap is attached to opposing sides of said base shell member, wherein said soft helmet is adapted to be retained on a human head with said retention strap.

7. The soft helmet having blunt force trauma protection of claim 6 wherein:

at least one ventilation opening is formed between adjacent bubbles of said plurality of non-bursting gas filled bubbles and through said at least one impact layer and said base shell member.

8. The soft helmet having blunt force trauma protection of claim 6 wherein:

said at least one impact layer is fabricated from two sheets of air impermeable material.

9. The soft helmet having blunt force trauma protection of claim 6 wherein:

at least one second impact layer, said at least one impact layer and said at least one second impact layer have a plurality of small round bubbles.

10. A soft helmet having blunt force trauma protection comprising:

a base shell member fabricated from a flexible sheet, said base shell member includes a substantially hemispherical shape, said base shell member is adapted to cover substantially all of a top of a user's head;

at least one impact layer includes a plurality of non-bursting gas filled bubbles, said at least one impact layer is fabricated from two sheets of gas impermeable material, each one of said plurality of non-bursting gas filled bubbles retains gas therein and does not pass the gas therein to an adjacent one of said plurality of non-bursting bubbles, said plurality of non-bursting bubbles do not burst upon impact, said at least one impact layer is attached to an outside surface of said base shell member, a minimum pressure of gas inside said plurality of non-bursting gas filled bubbles is at least 1.2 atmospheres; and a retention strap is attached to opposing sides of said base shell member, wherein said soft helmet is adapted to be retained on a human head with said retention strap.

11. The soft helmet having blunt force trauma protection claim 10 wherein:

at least one ventilation opening is formed between adjacent bubbles of said plurality of bubbles and through said at least one impact layer and said base shell member.

12. The soft helmet having blunt force trauma protection claim 10 wherein:

said gas being one of air, substantially pure nitrogen and argon.

13. The soft helmet having blunt force trauma protection claim 10 wherein:

at least one second impact layer, said at least one impact layer and said at least one second impact layer have a plurality of small round bubbles.

* * * * *